US005077946A

United States Patent [19]

Negendank et al.

[11] Patent Number: 5,077,946

[45] Date of Patent: Jan. 7, 1992

[54] INSTALLATION MODULE OR BLOCK

[75] Inventors: Volker Negendank, Pöcking; Jürgen Kress, Huglfing, both of Fed. Rep. of Germany

[73] Assignee: Sanbloc GmbH Installations-Fertigbau, Weilheim, Fed. Rep. of Germany

[21] Appl. No.: 539,080

[22] Filed: Jun. 15, 1990

[30] Foreign Application Priority Data

Jun. 29, 1989 [DE] Fed. Rep. of Germany ... 8907973[U]

[51] Int. Cl.[5] ..... E04B 1/94

[52] U.S. Cl. ..... 52/232; 52/404; 52/202

[58] Field of Search ..... 52/220, 232, 573, 404, 52/1, 221; 428/264, 265, 266, 267, 268, 272-275, 494, 500, 921; 106/DIG. 2

[56] References Cited

U.S. PATENT DOCUMENTS 3,185,297 5/1965 Rutledge ..... 52/232
4,109,423 8/1978 Perrain ..... 52/232 X
4,273,821 6/1981 Pedlow ..... 52/232 X
4,517,779 5/1985 Dunsworth ..... 52/232
4,936,064 6/1990 Gibb ..... 52/232

FOREIGN PATENT DOCUMENTS 8424828.9 8/1984 Fed. Rep. of Germany .
WO7611 10/1988 World Int. Prop. O. ..... 52/232

*Primary Examiner*—Richard E. Chilcot, Jr.
*Attorney, Agent, or Firm*—Dellett, Smith-Hill and Bedell

[57] ABSTRACT

An installation module or block, comprising a molded body, especially a foamed body (4) in which the pipes and structural members (5,6,7) needed for supply to and discharge from corresponding sanitary equipment are embedded as well as the fastening means needed to mount the sanitary equipment. A fire protection substance (10) spread substantially across the full area of the module is molded in the module between the front and rear walls (8, 9) thereof. Thus, when an installation module is built into a wall (3), that wall directly corresponds to the fire resistance class required under the building regulations.

9 Claims, 1 Drawing Sheet

INSTALLATION MODULE OR BLOCK

FIELD OF THE INVENTION

The instant invention relates to an installation module or block, comprising a molded body, especially a foamed body in which are received the pipes and structural members required for supply to and discharge from sanitary equipment as well as the fastening means needed to mount the sanitary equipment.

BACKGROUND OF THE INVENTION

German utility model DE-Gbm 84 24 828.9 discloses an installation module or block comprising a metallic carrier structure for at least one sanitary body, a flush tank, as well as supply and discharge pipes. The rear of this block is shielded by a fire protection plate which is fixed to the carrier structure. This fire protection plate made entirely or predominantly of mineral substances forms a construction unit together with the installation module, and the resulting unit is ready to be delivered as a whole to the job site to be built in. When an installation module furnished with such a fire protection plate is inserted in the opening or niche provided for this purpose in a wall bordering, for instance, on a supply shaft of a building, the required fire resistance class of that wall is restored automatically also in the area of the opening or niche in the wall.

Difficulties may arise from the fixing of the fire protection plate at the backside of the known installation module. In case of fire it cannot be excluded that the connection between the fire protection plate and the installation module becomes disintegrated, thereby cancelling the entire fire protection. The fastening means, if constituted by metal screws or bolts, may form heat transfer bridges which pose a threat to the fire protection system. There is also a risk of mechanical damage done to the fire protection plate during transport as it is fixed in open and unprotected manner against the back of the installation module.

No other, broader measures except the addition of fireproofing agents to the molding material have become known for an installation module (with one sanitary apparatus attached to it) or installation block (with two or more sanitary apparatus attached to it), wherein the piping and structural members needed for supply to and discharge from the respective sanitary equipment as well as the fastening means required to mount the sanitary equipment are embedded in a molded body, especially a foamed body. However, if the installation module or block is to meet the requirements of stipulated fire resistance classes, more far reaching fire protection measures are absolutely necessary in view of the fact that the fireproofing agent mixed with the molding material can offer sufficient fire protection only in those areas where the full thickness of the module is available, such as in the zones of the edges of the module. That is not true where the wall thickness of the installation module is greatly reduced, such as in the area of the inspection opening of a flush tank.

SUMMARY OF THE INVENTION

It is, therefore, an object of the instant invention to equip an installation module or block, comprising a molded body, especially a foamed body, such that, when installed in an opening or niche in a wall, the module or block will make the wall correspond directly to the fire resistance class demanded by building regulations.

This object is met, in accordance with the invention, by an installation module or block as characterized in claim 1. Further developments of the invention are specified in the subsidiary claims.

The installation module or block according to the invention is characterized in that a fire protection substance, plate, or mat is formed, during the molding, between the front and rear walls and so as to extend substantially across the full area of the module or block. It is preferred to use a fire protection substance, namely a mixture of mineral fiber wool with cement and gypsum as binders (Cafcote 280 by Messrs. Cafco Europe SARL, L-3895 Foetz), at a layer thickness of approximately 30 to 40 mm. During the manufacturing process of the module or block this fire protection substance is mixed with the material of the molded body (e.g. Legupren by Messrs. Bayer AG, D-5090 Leverkusen) in the areas of the edges of the module or block in order to improve the bond between the parts of the molded body in front of and behind the fire protection substance. This mixing may be done readily without threatening the fire protection since the material of the molded body, too, offers flame and fire protection and the full thickness of the module or block is available in the areas of its edges.

A fire protection plate or a fire protection mat of commercially available materials may be included in the molding instead of a fire protection substance.

It is convenient to mold the fire protection substance, plate, or mat like a shell around the embedded pipes and structural members as that will improve the stability and bond of the module or block. Particularly when using a fire protection substance, a distance should be kept from the pipes or structural members included in the molding. This assures that, in case the flush tank should burn out through the inspection opening, the fire protection substance cannot break into the resulting cavity but instead remains protected in the resinous expanded clay structure of the molded body which is made, for example, of Legopren.

In making a WC installation module, a spacer must be used to counteract the buoyancy of the flush tank received therein. The spacer itself is made of fire resistive material, such as calcareous sandstone and molded in the molded body in order not to cause any interruption of the fire protection substance, plate or mat.

BRIEF DESCRIPTION OF THE DRAWING

The invention will be described further, by way of example, with reference to the accompanying drawings, in which.

DESCRIPTION OF THE PREFERRED EMBODIMENT

Figure 1:
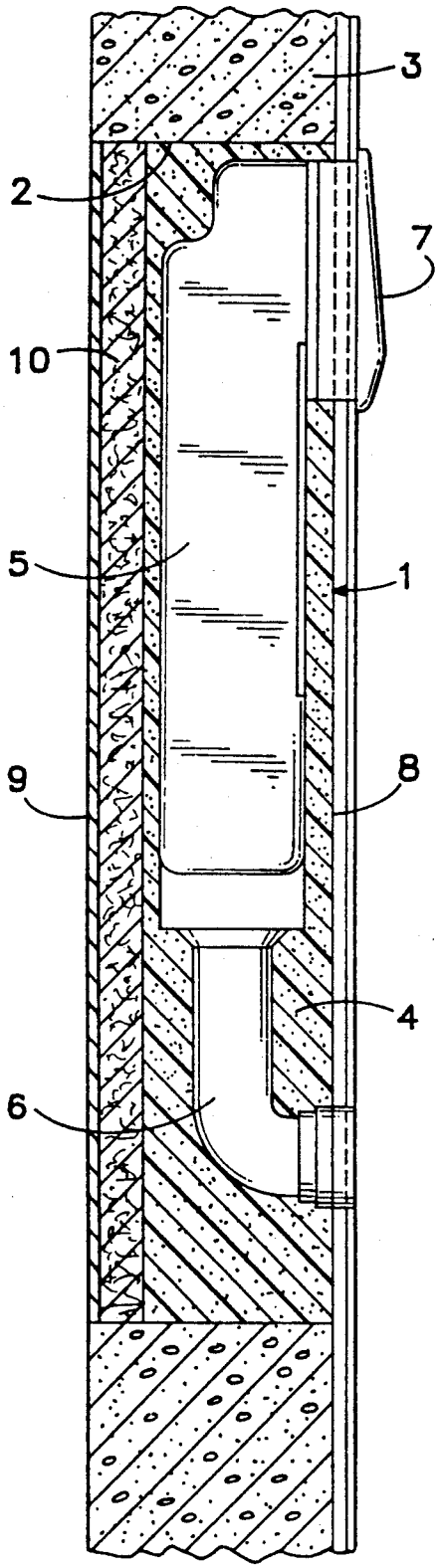
FIG. 1 is a longitudinal sectional elevation of a WC installation module with fire protection substance included in the molding.
Figure 2:
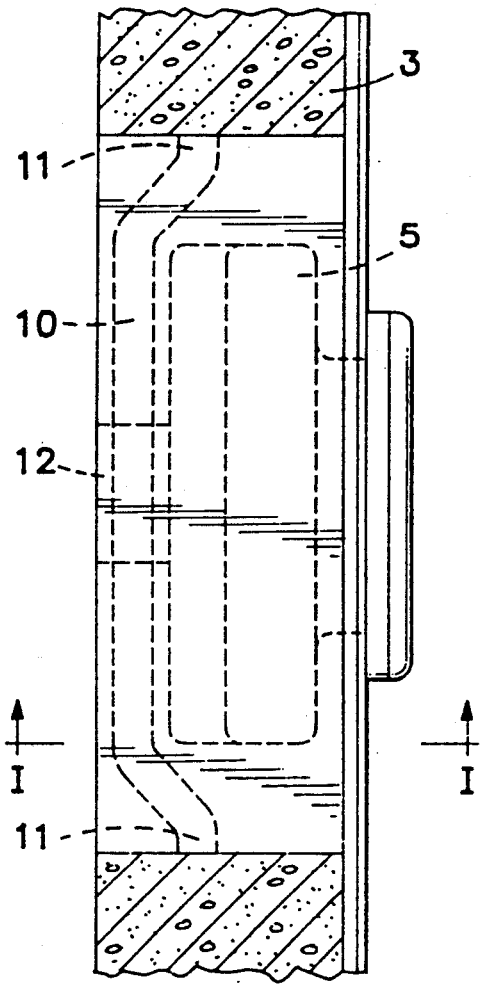
FIG. 2 is a top plan view of the module shown in FIG. 1.

The WC installation module 1 is installed in the opening 2 of a wall 3. It has substantially the same thickness as the wall. The molded body 4 of the WC installation module made, for instance, of polyester foamed concrete, is formed with a flush tank 5 of the wall-build-in type, including a flush pipe 6 and an inspection opening 7. A layer, approximately 30 to 40 mm thick, of a fire protection substance 10 is molded in the molded body 4 between the front wall 8 and the rear wall 9. This layer of fire protection substance 10 is laid like a shell around the flush tank 5. In the areas of the edges 11 of the module, the fire protection substance 10 is mixed with the material of the molded body. A block 12 of calcerous sandstone included in the molding serves as spacer to counteract the buoyancy of the built-in flush tank during the manufacturing process.

What is claimed is:

1. An article of manufacture, for use as installation module or block for sanitary equipment, comprising:

a molded body for receiving pipes and structural members required for sanitary equipment, the molded body having front and rear surfaces that are joined by opposite edges of the molded body, and a fire protection member embedded in the molded body between the front and rear surfaces and extending substantially across the entire width of the molded body from one of said edges to the oter edge.

2. The article as claimed in claim 1, wherein the fire protection member is molded like a shell around the pipes and structural members.

3. The article as claimed in claim 1, wherein the material of the fire protection member is mixed with the material of the molded body in the region of the edges of the molded body to improve the bond between parts of the molded body in front of the fire protection member and parts of the molded body behind the fire protection member.

4. The article as claimed in claim 1, wherein the fire protection member is spaced from the pipes or structural members in the molded body.

5. The article as claimed in claim 1, wherein the fire protection member defines interstices that are penetrated by the material of the molded body in the region of the edges of the molded body.

6. The article as claimed in claim 5, wherein the fire protection member is mixture of mineral fiber wool with cement and gypsum as binders and is applied as a layer approximately 30 to 40 mm thick.

7. The article as claimed in claim 1, wherein the molded body is a foamed body, flush tank is embedded in the molded body, a spacer of fire resistant material is positioned between the flush tank and the rear surfaces of the molded body, and the fire protection member is spread around the spacer.

8. An article of manufacture for use as installation module or block for sanitary equipment, comprising:

a molded body for receiving pipes and structural members required for sanitary equipment, the molded body having front and rear surfaces that are joined by two opposite side edges of the molded body and by opposite top and bottom edges of the molded body, and a fire protection member embedded in the molded body between the front and rear surfaces and extending substantially across the entire height and width of the molded body from one side edge to the opposite side edge and from the top edge to the bottom edge.

9. An installation module or block, for installing in an opening of a predetermined height and width in a wall of predetermined thickness to accommodate at least one toilet flush tank and to have at least one sanitary apparatus attached thereto, the installation module or block being sized and shaped to fit in said opening and comprising:

a molded body having front and rear surfaces that are joined by two opposite side edges of the molded body and by opposite top and bottom edges of the molded body, a flush tank embedded in the molded body between the front and rear surfaces thereof; and a fire protection member embedded in the molded body between the flush tank and the rear surface and extending substantially across the entire height and width of the molded body from one side edge to the opposite side edge and from the top edge to the bottom edge.

* * * * *